United States Patent [19]

Reed

[11] Patent Number: 4,538,442

[45] Date of Patent: Sep. 3, 1985

[54] METHOD OF PRESTRESSING A TUBULAR APPARATUS

[75] Inventor: Stuart E. Reed, Homeworth, Ohio

[73] Assignee: The Babcock & Wilcox Company, New Orleans, La.

[21] Appl. No.: 619,396

[22] Filed: Jun. 11, 1984

Related U.S. Application Data

[62] Division of Ser. No. 413,290, Aug. 31, 1982, abandoned.

[51] Int. Cl.[3] ..... B21D 51/04

[52] U.S. Cl. ..... 72/367; 29/455 R; 72/378

[58] Field of Search ..... 29/446, 455 R; 72/342, 72/364, 367, 378, 302, 700; 138/DIG. 5

[56] References Cited

U.S. PATENT DOCUMENTS

| | | | |
|---|---|---|---|
| 2,693,026 | 11/1954 | Simplaar . | |
| 2,924,245 | 2/1960 | Wilson . | |
| 3,023,495 | 3/1962 | Noland | 138/DIG. 5 |
| 3,041,717 | 7/1962 | Brown | 29/446 |
| 3,047,937 | 8/1962 | De Vecchi | 72/367 X |
| 3,232,638 | 2/1966 | Hollander | 138/DIG. 5 |
| 3,397,745 | 8/1968 | Owens et al. | 166/303 X |
| 3,511,282 | 5/1970 | Willhite et al. . | |
| 3,574,357 | 4/1971 | Alexandru et al. | 138/149 X |
| 3,654,691 | 4/1972 | Willhite et al. | 29/446 X |
| 3,693,665 | 9/1972 | Veerling et al. . | |
| 3,810,491 | 5/1974 | Hildebrandt | 29/446 X |
| 3,880,195 | 4/1975 | Goodrich et al. | 138/DIG. 5 |
| 3,911,963 | 10/1975 | Denoor et al. | 138/DIG. 5 |
| 4,130,301 | 12/1978 | Dunham et al. . | |
| 4,332,073 | 6/1982 | Yoshida et al. | 138/140 X |
| 4,340,245 | 7/1982 | Stalder . | |
| 4,377,894 | 3/1983 | Yoshida | 138/140 X |

FOREIGN PATENT DOCUMENTS

| | | | |
|---|---|---|---|
| 1258215 | 1/1968 | Fed. Rep. of Germany . | |
| 1583992 | 6/1971 | Fed. Rep. of Germany . | |
| 141322 | 11/1980 | Japan | 72/367 |
| 1455425 | 11/1976 | United Kingdom | 29/455 R |

*Primary Examiner*—Lowell A. Larson

*Attorney, Agent, or Firm*—Robert J. Edwards; James C. Simmons

[57] ABSTRACT

A tubular apparatus is assembled of inner and outer tubes which are connected at spaced locations along their length. After heat treatment and other processing steps, either the inner or outer tube is heated to reduce its yield strength and then stretched beyond its yield point but not beyond the yield point of the other tubular. The heat source is removed so that the stretched state is maintained. The tubular apparatus is thus prestressed with the inner tube under compressive prestressing when the inner tube has been heated and stretched, and the inner tube under tensile prestressing when the outer tube has been heated and stretched.

6 Claims, 6 Drawing Figures

80
70
60
50
40
30
20
10
0
σ INNER
UNLOAD
PLASTIC DEFORMATION OF OUTER; INNER TUBE PICKS UP ADDITIONAL LOAD
YIELDING OF OUTER TUBULAR BEGINS
EQUAL σ UP TO YIELD
BEGIN APPLYING LOAD TO TUBULARS
0
10
20
30
40
50
σ OUTER

METHOD OF PRESTRESSING A TUBULAR APPARATUS

This application is a divisional of co-pending application Ser. No. 413,290, filed Aug. 31, 1982 abandoned.

FIELD AND BACKGROUND OF THE INVENTION

The present invention relates, in general, to the prestressing of elongated conduits for conveying hot or cold fluid, and in particular to a new and useful method of manufacturing and prestressing tubular apparatus made of two or more coaxial tubes.

Heavy oil and tar sands represent huge untapped resources of liquid hydrocarbons which will be produced in increasing quantities to help supplement declining production of conventional crude oil. These deposits must, however, be heated to reduce the oil viscosity before it will flow to the producing wells in economical quantities. The dominant method of heating is by injection of surface generated steam in either a continuous (steam flood) or intermittent (steam stimulation or "huff and puff") mode.

When steam is injected down long injection pipes or "strings", a significant amount of thermal energy is lost to the rock overburden (500 to 7000 feet) which covers the oil deposit. In the initial steam injection projects, the price of oil did not justify the prevention of this heat loss, but now with the price of oil at $30.00 or more a barrel, insulation systems for the well injection pipe become economically justified.

Thermally insulated double wall piping structures are known and used, for example, as insulated steam injection tubing in oil wells, or in pipe lines for carrying fluids at elevated temperatures. Such piping is disclosed, for example, in U.S. Pat. No. 3,574,357 to Alexandru et al and U.S. Pat. No. 3,397,745 to Owens et al.

It is common practice for such tubes to be prestressed in order to compensate for differential expansion of the inner and outer coaxial walls or tubes. Such prestressing is done, for example, by elongating the inner tube through such means as heating or mechanically stretching and attaching the outer tube while the inner tube is in such an elongated state. While still held in the elongated state, any heat treatment required for the attachment is completed. However, it is difficult to heat treat the welds while the tubes are under stress. For this reason, it is believed that such heat treatment of the welds is not normally done in the industry, resulting in welds which are more brittle, more damage prone, and more corrosion prone.

After cool down of the heat treatment, if any, the heating or mechanical stretching is then removed and the tubes assume a state of tensile prestress on the inner tube and compressive prestress on the outer tube. While in service, the inner tube becomes hot and expands. This relaxes the tensile prestress before the inner tube goes into compression. In this manner, the inner tube is prevented from buckling.

In an analogous fashion, where the inner tube is adapted to convey cold fluids, the outer tube is heated or mechanically stretched before the inner tube is connected thereto.

Disadvantages of these prior approaches to prestressing double walled tubes or conduits is that the inner, outer, or both tubes must be held in their compressed or stretched state while other manufacturing steps are accomplished such as the connection of the tubes, the heat treatment thereof and the cool-down therefrom.

SUMMARY OF THE INVENTION

According to the present invention, a desired state of prestress is established in a double wall tubing structure, while difficulties and disadvantages of the prior art methods are avoided.

According to the method of this invention, the tubes or pipes are assembled and fixedly joined to each other without prestressing. Any required heat treatment of the structure or the joint is then performed again without any prestress condition. To achieve a prestress, the outer tube member is locally heated to reduce its yield strength and then is mechanically stressed beyond its yield strength. The heat source is removed so that the mechanical stretching is rendered permanent. The outer tube portion is thus plastically deformed while the inner tube portion remains elastic. After cooling, the load establishing the mechanical stretching can be removed. Upon complete cooling, the desired prestress condition is present with a tensile force on the inner tube and a compressive force on the outer tube.

This structure is useful in conveying hot fluids such as steam in the inner tube portion.

Where cold fluids are to be conveyed, such as liquefied natural gas, it is desirable to have a tensile prestressing on the outer tube and a compressive prestressing on the inner tube. This is achieved according to the invention by heating at least a portion of the inner tube to reduce its yield strength and mechanically stressing the inner tube beyond its yield strength. The heat source is then removed. The inner tube portion is thus plastically deformed while the outer tube portion remains elastic.

The present invention eliminates the need to maintain the elongation of one tube relative to the other tube while joining them together or the need to maintain such elongation while performing heat treatment operations. This simplifies these operations and reduces their cost, especially since heat treatment of the members connecting the tubulars is very difficult to perform while the tubulars are in a prestressed condition. This method permits the prestressing to be performed at a convenient time in the production sequence and after any operations which may produce rejectable parts. Thus, the prestressing steps are achieved only after all previous steps have been accomplished satisfactorily. This reslts in a faster and less expensive production sequence and decreases the production investment in rejectable parts.

Accordingly, another object of the invention is to provide a method of prestressing a double wall tube having an inner tubular and an outer tubular connected to the inner tubular at at least two spaced locations along their length, comprising, heating at least a portion of one of the inner and outer tubulars sufficiently to reduce the yield strength thereof, mechanically stretching said one of the inner and outer tubulars to elongate said one of the inner and outer tubulars by a selected amount, and permitting said one of the inner and outer tubulars to cool.

A still further object of the invention is to provide a method of manufacturing a prestressed double wall tube having an inner tubular connected to an outer tubular at at least two spaced locations along their length comprising, providing the inner tubular with a material having a different yield strength than the outer tubular and stretching the tubular which has a lower yield strength past its yield but not stretching the tubular which has the higher yield strength past its yield point to prestress the double wall tube.

The various features of novelty which characterize the invention are pointed out with particularity in the claims annexed to and forming a part of this disclosure. For a better understanding of the invention, its operating advantages, and specific objects attained by its uses, reference is made to the accompanying drawings and descriptive matter in which preferred embodiments of the invention are illustrated.

DESCRIPTION OF THE PREFERRED EMBODIMENTS

Figure 1:
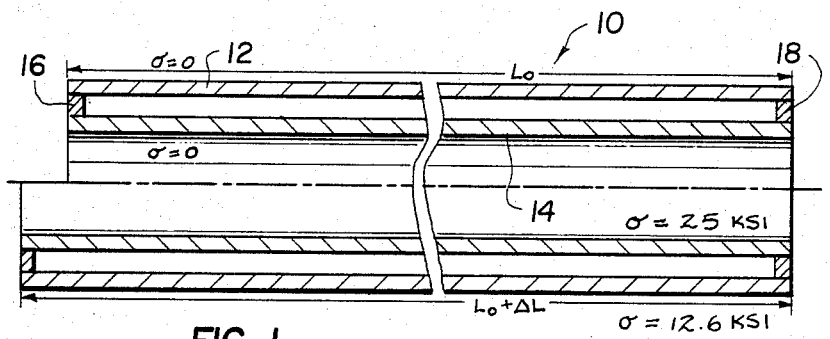
FIG. 1 is a side sectional view of a double wall tube according to the invention showing at the top half an unstressed condition and at the bottom half a prestressed condition.

Referring to the drawings in particular, the invention embodied therein comprises a method of prestressing a double wall tube generally designated 10 in FIG. 1, which comprises an outer tubular 12 and an inner tubular 14 which are connected to each other at axially spaced joints 16 and 18, which are preferably at or near the ends of tubulars 12, 14.

The upper half of FIG. 1 shows the double wall tube before it is prestressed. In the embodiment shown the length $L_o$ is chosen to be 40 feet and the material, at least of the outer tubular, is chosen to be carbon steel.

The lower half of FIG. 1 shows the stretched and prestressed state of double wall tube 10. The length has been increased by an amount $\Delta L$.

For this example, suppose that the tubulars are chosen to be:

Outer tubular:
- 40 ft long
- $4\frac{1}{2}''$ OD
- 0.271" wall
- carbon steel
- 55 KSI room temperature yield strength
- Area of cross section = 3.600 $in^2$ Inner tubular:
- 40 feet long
- $2\frac{7}{8}''$ OD
- 0.217" wall
- carbon steel
- 80 KSI room temperature yield strength
- Area of cross section = 1.812 $in^2$;

and that the desired level of prestress in the inner tubular is 25 KSI (tension). At isothermal conditions (same temperature on both tubes), the corresponding stress in the outer tubular is 12.6 KSI compression.

The inner tubular is inserted into the outer tubular, the tubes are welded together at each end with no prestress and the welds are heat-treated as required.

Figure 5:
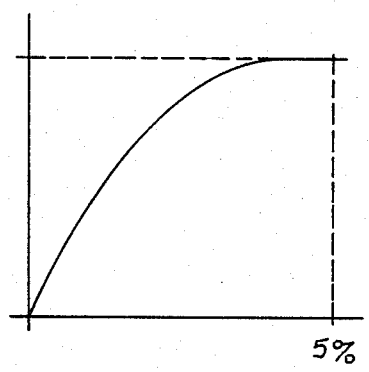
FIG. 5 is a graph showing the relationship between stress and strain for a typical carbon steel at 1100 degrees F.

To produce the desired condition of prestress, the outer tube is first heated to 1100° F. over a length of 12 inches. A typical stress-strain curve for a carbon steel at this temperature is shown in FIG. 5. Both tubes are then subjected to a load of 271.8 Kips (thousand pounds). This load produces a stress in the inner tube of 75 KSI tension (elastic) and in the outer tube of 37.75 KSI tension. In the heated portion of the outer tube, this stress produces 5% plastic strain, while in the cooler portion, the stress is still elastic. The 5% plastic strain over a 12 inch length results in a total overall length increase of 0.6 inch. When the outer tube cools to about 800° F., the load is removed. When the outer tube has cooled to room temperature, the 0.6 inch length increase results in the desired stress state: 25 KSI tension in the inner tube, 12.6 KSI compression in the outer tube.

In its prestressed condition, the inner tubular thus is exposed to an incremental stress $\sigma$ of 25 KSI. Factoring in the difference in area of the inner and outer tubulars, this corresponds to a compressive stress on the outer tubular of $\sigma = 12.6$ KSI.

Figure 2:
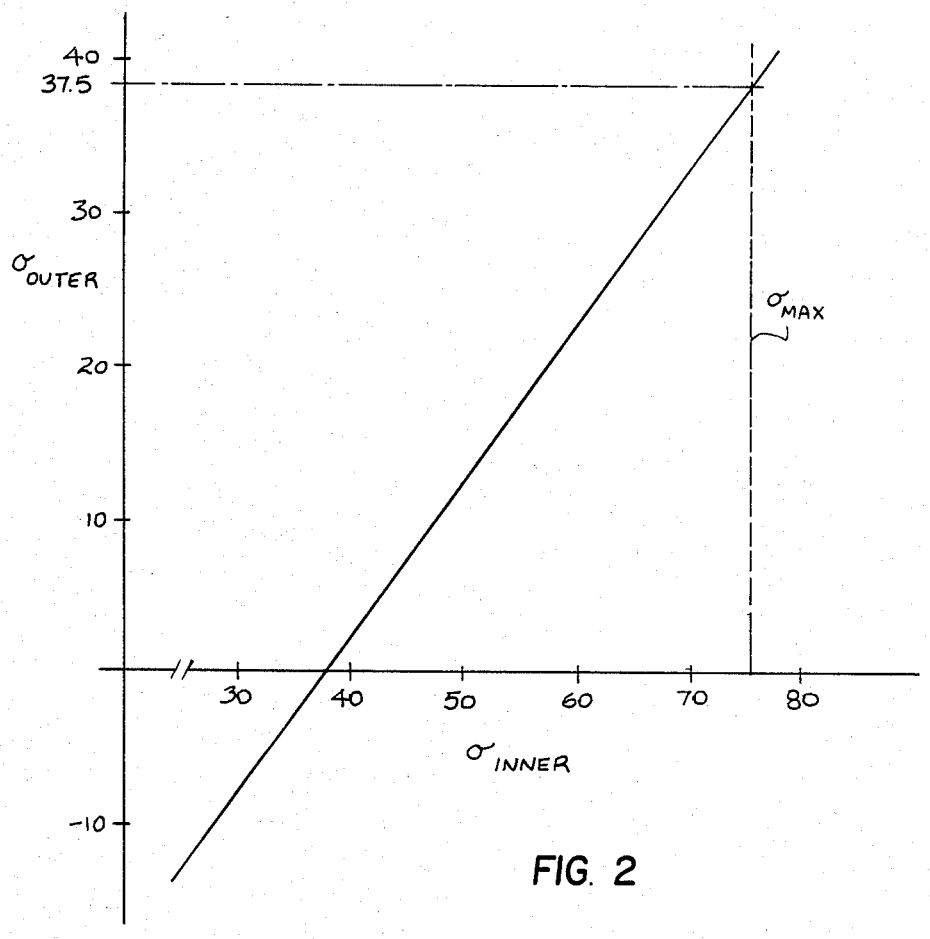
FIG. 2 is a graph showing the relationship between stresses in the outer and inner tubulars after prestressing due to an externally applied force.

FIG. 2 shows the relationship between the incremental stresses on the inner and outer tubulars with a maximum on the outer tubular being 37.5 KSI. This maximum level is established since above this level the yield strength for the inner tubular is approached.

Figure 3:
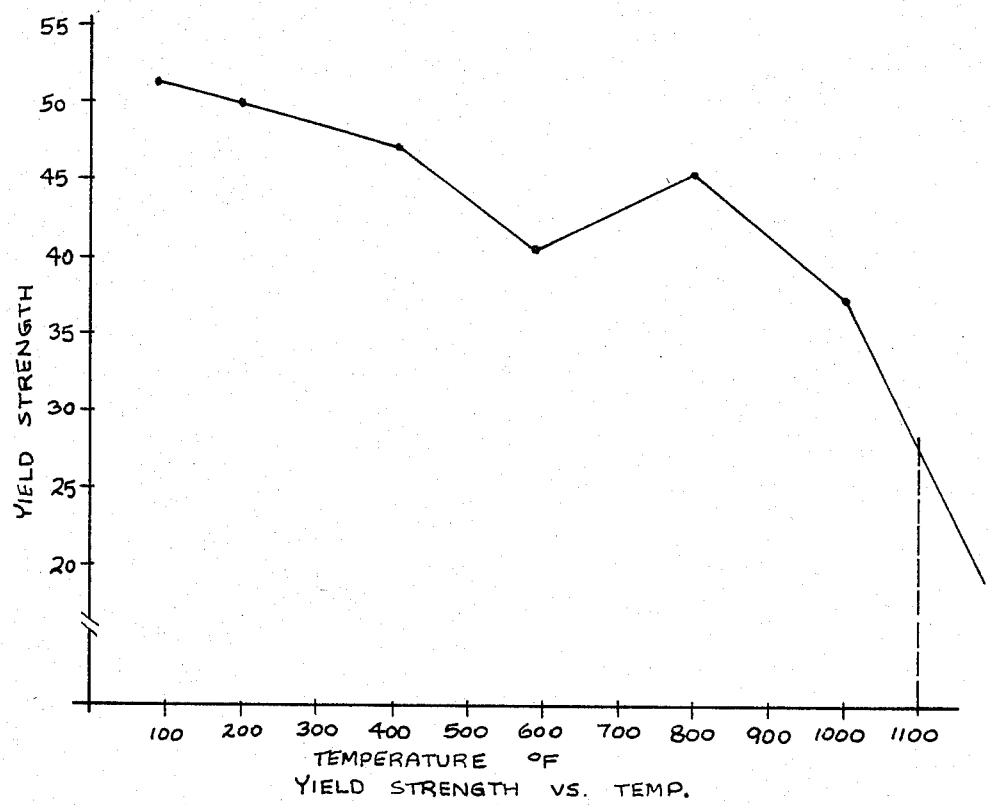
FIG. 3 is a graph showing the yield strength of a typical carbon steel versus temperature.

FIG. 3 shows the relationship between temperature in degrees Fahrenheit and yield strength for a typical carbon steel used for the outer tubular (e.g. 8260 annealed steel). In order to reduce the yield strength to less than 37.5 KSI, a temperature of at least about 1000 degrees F. is required. In fact, the yield strength must be somewhat lower since the outer tube must not only yield but it must also undergo some strain.

Figure 4:
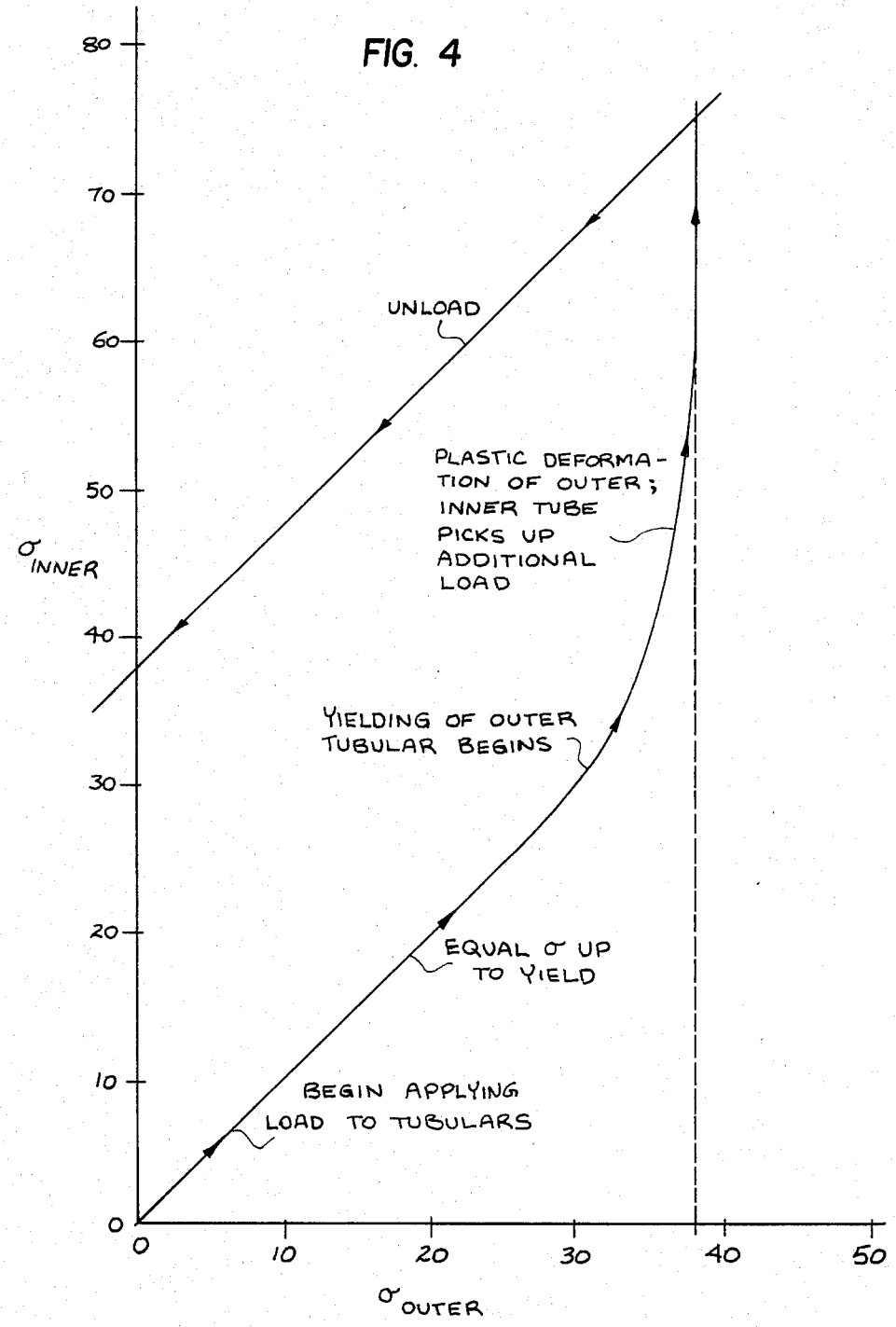
FIG. 4 is a graph showing the stress in the inner tubular as it relates to the stress in the heated outer tubular during the prestressing process.

FIG. 4 illustrates how the force applied to the outer tubular initially effects a linear increase in length. Once the yield point is reached for the outer tubular, however, the increase becomes non-linear and corresponds to plastic deformation of the outer tubular. With a release of the load, the prestress on the inner tubular decreases until it reaches the desired level of 25 KSI. This is a condition which is in equilibrium with the 12.6 KSI compressive prestress on the outer tubular.

By selecting the temperature and the heated length for the outer tubular, the prestress on the inner tubular can be controlled. The stress (strain state) at the completion of yielding must fall on the curve shown in FIG. 2. Once the stress-strain curve for the outer tubular is known, the heated length can be determined as can the temperature of the operation.

As long as the temperature is such that the minimum yield of the outer tube is greater than 12.6 KSI, it is probably not necessary to hold the prestress once the yielding has occurred. This is assuming that the heated length is short enough so as not to buckle.

Figure 6:
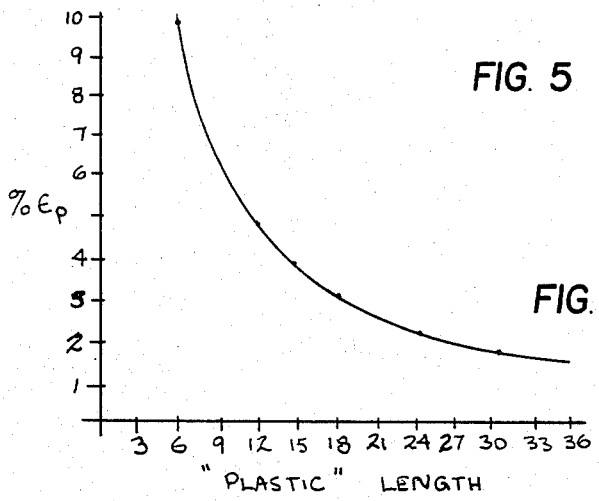
FIG. 6 is a graph relating the plastic (heated) length of the outer tubular to the plastic strain needed for a given total elongation.

The required plastic deformation ($\Delta L$) is about 0.6 inches with the plastic strain needed as a function of the heated length being shown in FIG. 6.

The double wall tube described above is useful where the inner tube is intended to convey heated substances such as steam. Where the inner tube is intended to convey cold substances such as liquefied natural gas, the inner tube rather than the outer tube can be heated and stretched.

As an alternate measure, the material making up the inner and outer tubulars can be chosen to have different yield strengths, with the member to be plastically deformed having the lower yield strength.

It is noted that two or more inner tubes may be provided within the outer tube and may be prestressed to different levels. This is possible by providing the tubes with different yield strengths. The inner tubes may be axially spaced and aligned, disposed one next to the other or one within the other.

It is also advantageous to insulate the annular space formed between the inner and outer tubes. This can be done by providing fibers or layered insulation which is preferably wrapped around the inner tube. A thermal barrier can also be established by evacuating the annular space. The evacuated space may be used in conjunction with the fibrous or layered insulation, or alone. To maintain the vacuum over a prolonged period of use for the tubing, a getter material is provided, preferably at a high temperature location within the annular space, that absorbs such gases. Such a getter material is preferably adjacent the inner tube and activatable at a temperature between 400° and 700° F. Gases which may leak into the vacuum include hydrogen formed by corrosion on the outer tube migrating through the outer tube and such gases as nitrogen and carbon monoxide outgassed from the material of the inner tube.

In an alternative embodiment of this invention, the inner tubular 14 is composed of a material which has a higher yield strength than the material of the outer tubular, and the stress in the inner tubular 14 is not allowed to exceed its yield strength while the outer tubular 12 is stretched such that its yield strength is exceeded. This results in a prestressed condition which is limited by the difference in the yield strengths of the tubulars.

While a specific embodiment of the invention has been shown and described in detail to illustrate the application of the principles of the invention, it will be understood that the invention may be embodied otherwise without departing from such principles.

What is claimed is:

1. A method of prestressing tubular apparatus having at least one metal inner tubular and a metal outer tubular positioned coaxially around and spaced apart from and connected to the inner tubular at at least two spaced locations along the length thereof, comprising:

heating at least a portion of one of the inner and outer tubulars to a temperature sufficient for reducing the yield strength of said portion of said one of the inner and outer tubulars to a yield strength which is less than the yield strength of the other of the inner and outer tubulars;

while said tubulars are connected, stretching the inner an outer tubulars in a lengthwise direction by a selected amount which is beyond the yield point of said one tubular and which is not beyond the yield point of said other tubular; and permitting said one of the inner and outer tubulars to cool while said tubulars are stretched whereby the double wall tube is prestressed and the inner and outer tubulars remain spaced from each other.

2. A method according to claim 1 including heating and mechanically stretching the outer tubular so as to apply a compressive prestressing thereto and so as to apply a tensile prestressing to the inner tubular.

3. A method according to claim 1 including heating and stretching the inner tubular so as to apply a compressive prestressing thereto and so as to apply tensile prestressing to the outer tubular.

4. A method according to claim 1 wherein said tubulars are connected at said two spaced locations by welding to form welds, the method including heat treating the welds before stretching the tubulars.

5. A method of prestressing a tubular apparatus having at least one metal inner tubular and a metal outer tubular positioned coaxially around and spaced apart from and connected to the inner tubular at at least two spaced locations along the length thereof, comprising: providing the inner and outer tubulars of materials having different yield strengths, and, while said tubulars are connected, mechanically stretching the inner and outer tubulars in a lengthwise direction so that the tubular having the lower yield strength is stretched beyond its lower yield strength and the inner and outer tubulars remain spaced from each other.

6. A method according to claim 5 wherein said tubulars are connected at said two spaced locations by welding to form welds, the method including heat treating the welds before stretching the tubulars.

* * * * *